US009285179B2

(12) United States Patent
Prater

(10) Patent No.: US 9,285,179 B2
(45) Date of Patent: Mar. 15, 2016

(54) CABLE GUARD FOR COMPOUND BOW

(71) Applicant: Prater Custom Archery, LLC, Davison, MI (US)

(72) Inventor: Don C Prater, Davison, MI (US)

(73) Assignee: Prater Custom Archery, LLC, Davison, MI (US)

( * ) Notice: Subject to any disclaimer, the term of this patent is extended or adjusted under 35 U.S.C. 154(b) by 0 days.

(21) Appl. No.: 14/219,765

(22) Filed: Mar. 19, 2014

(65) Prior Publication Data

US 2014/0283807 A1 Sep. 25, 2014

Related U.S. Application Data

(60) Provisional application No. 61/803,161, filed on Mar. 19, 2013.

(51) Int. Cl.
*F41B 5/10* (2006.01)
*F41B 5/14* (2006.01)

(52) U.S. Cl.
CPC ..... *F41B 5/1403* (2013.01); *F41B 5/10* (2013.01)

(58) Field of Classification Search
CPC ..... F41B 5/10; F41B 5/1407; F41B 5/1426
See application file for complete search history.

(56) References Cited

U.S. PATENT DOCUMENTS

| | | | | |
|---|---|---|---|---|
| 4,203,412 | A | | 5/1980 | Rickard |
| 4,917,070 | A | | 4/1990 | Townsend |
| 4,919,108 | A | | 4/1990 | Larson |
| 5,623,915 | A | | 4/1997 | Kudlacek |
| 5,651,355 | A | * | 7/1997 | Gallops, Jr. ..... 124/25.6 |
| 5,720,269 | A | * | 2/1998 | Saunders ..... 124/86 |
| 5,983,880 | A | | 11/1999 | Saunders |
| 6,152,124 | A | | 11/2000 | Gallops, Jr. |
| 6,659,096 | B1 | | 12/2003 | Nealy, Sr. et al. |
| 6,715,479 | B1 | | 4/2004 | Bunk |
| 6,722,354 | B1 | | 4/2004 | Land |
| 6,729,320 | B1 | | 5/2004 | Terry |
| 8,176,906 | B2 | | 5/2012 | Simo et al. |
| 8,371,283 | B2 | | 2/2013 | Grace et al. |
| 2012/0042861 | A1 | | 2/2012 | Anselmo |
| 2013/0055995 | A1 | | 3/2013 | Batdorf |
| 2013/0055997 | A1 | | 3/2013 | Badgerow |
| 2013/0061838 | A1 | | 3/2013 | Gordon et al. |
| 2013/0247888 | A1 | | 9/2013 | McPherson |

OTHER PUBLICATIONS http://www.archerytalk.com/vb/showthread.php?t=2216756; Mar. 21, 2014; pp. 1-9.
http://www.biggamehunt.net/reviews/bear-archery-anarchy-bow-review; Dec. 13, 2011; pp. 1-6.

* cited by examiner

*Primary Examiner* — John Ricci
(74) *Attorney, Agent, or Firm* — Bejin Bieneman PLC

(57) ABSTRACT

A cable guard for a compound bow deflects cables of the compound bow away from the path of an arrow and away from a plane in which a string of the compound bow travels to prevent interference between the cables and the arrow and string. The compound bow includes a riser and spaced apart limbs extending from the riser. The cables and the string extends between the limbs. The cable guard comprises a frame for attachment to the compound bow. A first bearing is supported by the frame and extends along an axis. A second bearing and a third bearing each extend along a respective axis transverse to the axis of the first bearing. The second bearing and the third bearing each present a bearing surface with the bearing surface of the second bearing spaced from and facing the bearing surface of the third bearing for receiving the cable therebetween.

23 Claims, 13 Drawing Sheets

CABLE GUARD FOR COMPOUND BOW

CROSS-REFERENCE TO RELATED APPLICATIONS

The subject patent application claims priority to and all the benefits of U.S. Provisional Patent Application No. 61/803,161 filed on Mar. 19, 2013, which is herein incorporated by reference in its entirety.

BACKGROUND OF THE INVENTION

1. Field of the Invention

The present invention is directed toward a cable guide for a compound bow for directing at least one cable of the compound bow away from the path of an arrow on the compound bow.

2. Description of the Related Art

A compound archery bow includes a riser and a pair of limbs extending from opposing ends of the riser. Each limb supports a pulley. A string extends between and is connected to the pulleys. Free of external forces, the string and limbs are typically in a brace position and the string can be loaded with an arrow and drawn to move the string and limbs to a drawn position before propelling the arrow.

At least one cable extends between the pulleys for assisting in movement of the string and limbs to the drawn position. For example, one cable is connected to and extends from one pulley to the opposite limb and another cable is connected to and extends from the other pulley to the other limb.

By drawing the string from the brace position to the drawn position, the string rotates the pulleys thereby drawing in the cables and pulling the limbs toward each other. Specifically, an arrow is loaded on the string and the string is drawn from the brace position to the drawn position and subsequently released to propel the arrow. When the limbs are flexed and drawn toward each other as the string is drawn, the limbs are loaded, and subsequent release of the string allows the limbs to unload to return the string to the brace position and propel the arrow.

The bow typically includes a cable guide for deflecting the cables away from the path of the arrow and away from a plane in which the string travels to prevent interference between the cables and the arrow and string. When the string is moved between the brace position and the drawn position, the rotating pulleys move the cables vertically relative to the cable guard and the rotating pulleys and flexing limbs urge the cables fore and aft relative to the cable guard. Over time, relative movement between the cables and the cable guard wears both the cables and the cable guide. This wear can generate unwanted noise and undesirably complicate the operation of the bow.

SUMMARY OF THE INVENTION AND ADVANTAGES

A cable guard is for a compound bow. The compound bow includes spaced apart limbs and a cable extending between the limbs. The cable guard comprises a frame for attachment to the compound bow. A first bearing is supported by the frame and extends along an axis for contacting the cable. A second bearing and a third bearing each extend along a respective axis transverse to the axis of the first bearing. The second bearing and the third bearing each present a bearing surface with the bearing surface of the second bearing spaced from and facing the bearing surface of the third bearing for receiving the cable therebetween.

The cable guard deflects cable of the compound bow away from the path of an arrow and away from a plane in which a string of the compound bow travels to prevent interference between the cables and the arrow and string. As the string of the compound bow is moved between a brace position and a drawn position, the cable rides on the first bearing and the cable and is biased toward one of the second bearing and the third bearing. Specifically, when the bow is in the brace position, the cable is biased toward the second bearing and, as the string is moved to the drawn position, the cable is biased toward the third bearing. The cable is retained on the first bearing between the bearing surfaces of the second and third bearings.

The first, second, and third bearings effectively retain the cable away from the path of the arrow and the plane in which the string travels by maintaining the cable on the first bearing between the second and third bearings. This configuration reduces friction between the bearings and the cable to prolong the useful life of the bearings and the cable and to permit a smoother and quieter action as the string is moved between the brace and drawn positions.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

With reference to the Figures, wherein like numerals indicate like parts throughout the several views, a cable guard 10, 110, 210 for a compound bow 12 is shown. The compound bow 12 can be of any type without departing from the nature of the present invention.

Figure 1:
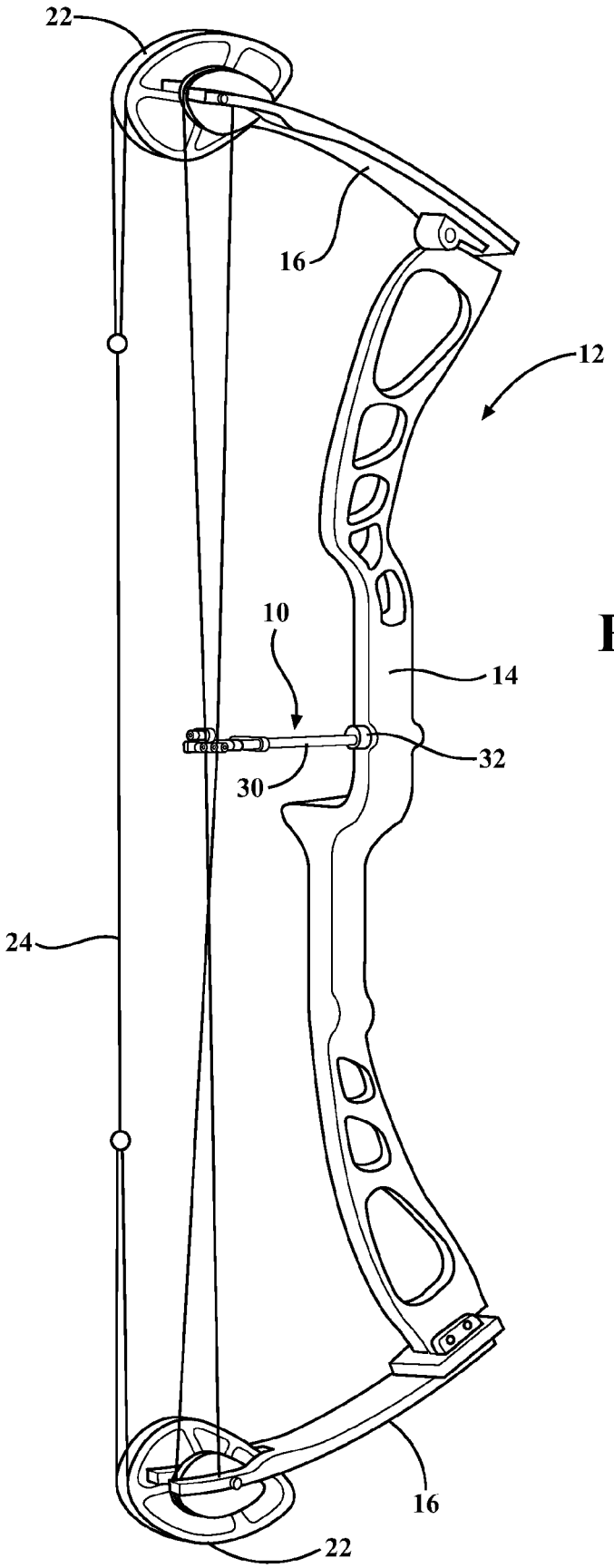
FIG. 1 is a perspective view of a compound bow in a brace position and including a first embodiment of a cable guard.
Figure 2:
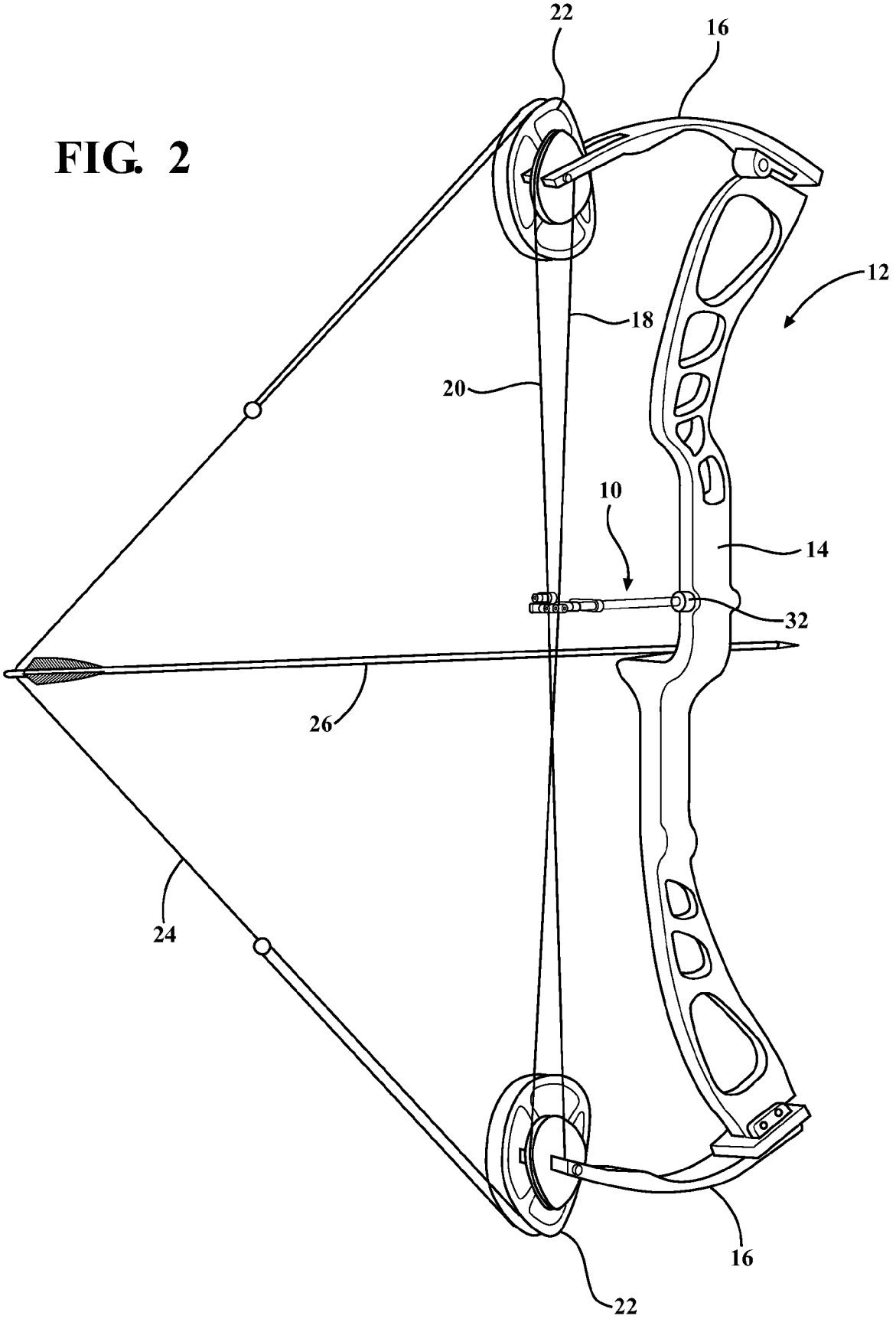
FIG. 2 is a perspective view of the compound bow of FIG. 1 in the drawn position.

With reference to FIGS. 1 and 2, the compound bow 12 includes a riser 14 and a pair of limbs 16 extending from opposing ends of the riser 14. At least one cable extends between the limbs 16. For example, as shown in FIGS. 1 and 2, typically two cables, identified as a first cable 18 and a second cable 20 below, extend between the limbs 16. Pulleys 22 are disposed on each limb 16 and the first cable 18 extends from one pulley 22 to the opposing limb 16 and the second cable 20 extends from the other pulley 22 to the other limb 16.

A string 24 extends between the limbs 16. Specifically, the string 24 is typically engaged with and extends between the pulleys 22. By drawing the string 24 from the brace position, as shown in FIG. 1, to the drawn position, as shown in FIG. 2, the string 24 rotates the pulleys 22 thereby drawing in the cables 18, 20 and resiliently flexing the limbs 16 toward each other. During this movement, the cables 18, 20 move vertically relative to the cable guard 10, 110, 210. At least one of the pulleys 22 is typically cammed. The pulleys 22, and associated cables 18, 20, can be of any type without departing from the nature of the present invention. For example, the pulleys 22 can be a single cam, hybrid cam, dual cam, binary cam, cam and a half, etc.

The cable guide 10, 110, 210 deflects the cables 18, 20 away from the path of an arrow 26 loaded on the compound bow 12 and away from a plane in which the string 24 travels to prevent interference between the cables 18, 20 and the arrow 26 and string 24. A first embodiment of the cable guard 10 is shown in FIGS. 1-5, a second embodiment of the cable guard 110 is shown in FIGS. 6-8, and a third embodiment of the cable guard 210 is shown in FIGS. 9-12. Common features are identified with common numerals throughout the figures.

The cable guard 10, 110, 210 includes a frame 28 for attachment to the compound bow 12. Specifically, the frame 28 is typically attached to and extends from the riser 14. The frame can be formed of any suitable material such as, for example, aluminum, titanium, etc. The frame can be formed, for example, by metal injection molding (MIM).

The frame 28 includes a rod 30 that is configured to be removably coupled with the riser 14. For example, the riser 14 defines a bore (not numbered) to which the rod 30 can be coupled. As one example, the bore in the riser 14 directly receives the rod 30 with a set screw retaining the rod 30 in the bore.

Figure 11A:
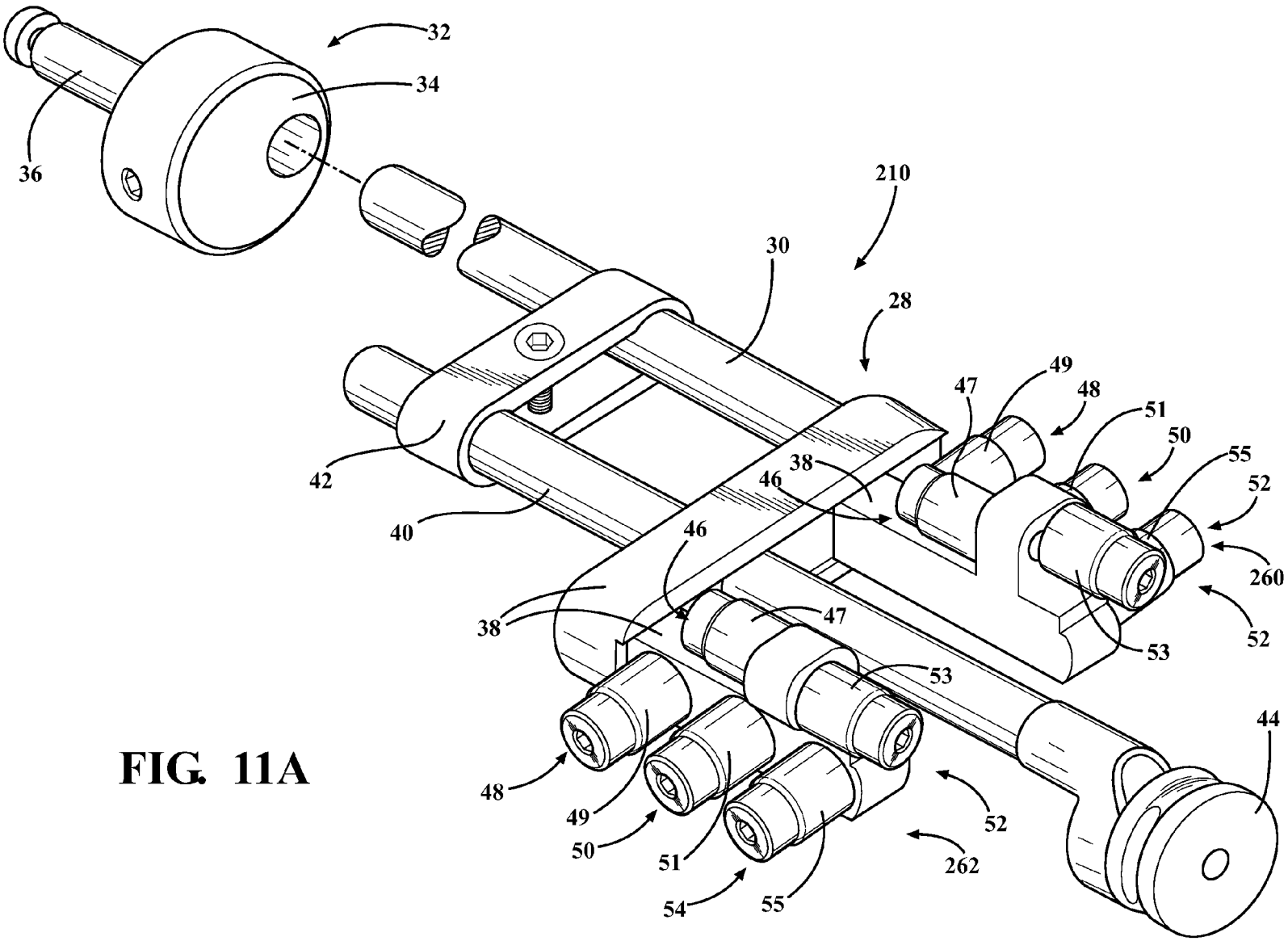
FIG. 11A is a partially exploded perspective view of the third embodiment of the cable guide.

Alternatively, an adapter 32 is coupled to the rod 30 and engages the bore of the riser 14, as shown in FIG. 11A. The adapter 32 includes an intermediate member 34 and a second rod 36 extending from the intermediate member 34 in an opposite direction than the rod 30. At least one of the rod 30 and the second rod 36 is selectively rotatable relative to the intermediate member 34. For example, as shown in FIG. 11, the rod 30 extends into a hole (not numbered) of the intermediate member 34 and is selectively fixed to the intermediate member 34 with a set screw. It should be appreciated that one or both of the rod 30 and the second rod 36 can be selectively rotatable and selectively fixed to the intermediate member 34 in any suitable fashion.

The rod 30 and the second rod 36 extend along axes that are offset from each other such that rotation of the rod 30 and/or the second rod 36 relative to the intermediate member 34 adjusts the position of the frame 28 relative to the riser 14. For example, in the embodiment shown in FIG. 11A, the second rod 36 is inserted into the riser 14 with the set screw loosened so that the rod 30 is rotatable relative to the intermediate member 34. The rod 30 and second rod 36 are rotated relative to each other to position the frame 28 in a desired position relative to the riser 14. When the desired position is attained, the rod 30 is fixed to the intermediate member 34 and the second rod 36 is fixed to the riser 14 to fix the frame 28 relative to the riser 14.

The frame 28 of the cable guard 10, 110, 210 is stationary relative to the riser 14 as the string 24 moves between the brace position and the drawn position. Alternatively, the rod 30 can, for example, include a feature (not shown) that allows the rod 30 to flex to reduce cam lean.

The frame 28 includes a base 38 connected to the rod 30. The base 38 and the rod 30 can be formed separately and affixed to one another. Alternatively, the base 38 and the rod 30 can be integral, i.e., formed together from a single piece of material.

With reference to FIGS. 6-12, the frame 28 can include a reinforcing rod 40 extending from the base 38 and a brace 42 extending between the rod 30 and the reinforcing rod 40. The second rod 36 and the brace 42 provide additional torsional stability. The reinforcing rod 40 and the brace 42 are shown, for example, with the second and third embodiment of the cable guard 110, 210; however, it should be appreciated that the first embodiment can include the reinforcing rod 40 and the brace 42.

With reference to FIGS. 9-12, the frame 28 can support a string suppressor 44. The string suppressor 44 extends from the frame 28 toward the string 24 for contacting the string 24. Specifically, the string 24 contacts the string suppressor 44 as the string 24 moves from the drawn position to the brace position. The string suppressor 44 quiets the operation of the bow 12 and reduces vibration when the string 24 moves from the drawn position to the brace position. The string suppressor 44 is shown, for example, in the third embodiment of the cable guard 210; however, it should be appreciated that the first and/or second embodiment of the cable guard 10, 110 can also include the string suppressor 44.

With reference to FIGS. 1-5, the cable guard 10 of the first embodiment includes five bearings, namely a first bearing 46, a second bearing 48, a third bearing 50, a fourth bearing 52, and a fifth bearing 54 each supported by the frame 28. The first bearing 46, second bearing 48, and third bearing 50 are arranged in a U-shape to receive the first cable 18 in the U-shape and the third bearing 50, fourth bearing 52, and fifth bearing 54 are arranged in a U-shape to receive the second cable 20 in the U-shape.

The bearings 46, 48, 50, 52, 54 are typically rotatable about their respective axis A1, A2, A3, A4, A5. As set forth above, the cables 18, 20 move vertically relative to the cable guard 10, 110, 210 and, in the configuration where the bearings rotate about their respective axis, the bearings rotate as the cables 18, 20 move. This rotation of the bearings reduces friction and associated wear on the cables 18, 20. The bearings 46, 48, 50, 52, 54, for example, can be needle bearings. Alternatively, for example, each bearing 46, 48, 50, 52, 54 can be a bushing on a shoulder bolt. The bushing can be, for example, ceramic, a plastic such as Delrin, Nylon, Teflont, etc., or any other suitable material. It should be appreciated that the bearings 46, 48, 50, 52, 54 can be of any suitable type without departing from the nature of the present invention.

As shown in FIGS. 1 and 2, the first cable 18 contacts the first bearing 46 and the second cable 20 contacts the fourth bearing 52. The first bearing 46 extends along an axis A1. The fourth bearing 52 extends along an axis A4 that is typically parallel with the axis A1 of the first bearing 46. The axis A1 of the first bearing 46 and the axis A4 of the fourth bearing 52 are typically offset from each other to provide clearance between the first cable 18 and the second cable 20. The axes A1, A4 of the first bearing 46 and fourth bearing 52 can alternatively be non-parallel or can be overlapping, i.e., the first bearing 46 and the fourth bearing 52 can share a common axis.

The second bearing 48 and third bearing 50 each extend along a respective axis A2, A3 transverse to the axis A1 of the first bearing 46. The fifth bearing 54 is adjacent the third bearing 50 and the third bearing 50 and the fifth bearing 54 extend along an axis A5 transverse to the axis A4 of the fourth bearing 52.

The axes A2, A3, A5 of the second bearing 48, the third bearing 50, and the fifth bearing 54 are typically parallel to each other, as shown in FIGS. 1-5, and are typically in a common plane. Alternatively, the axes of at least one of the second bearing 48, the third bearing 50, and the fifth bearing 54 can be non-parallel to the others and or in a different plane than the others.

In the configuration in which the axes A2, A3, A6 of the second bearing 48, the third bearing 50, and the fifth bearing 54 are parallel to each other, as shown in FIGS. 1-5, the axes A2, A3 of the second bearing 48 and the third bearing 50 are typically perpendicular to the axis A1 of the first bearing 46, and the axes A3, A5 of the third bearing 50 and the fifth bearing 54 are typically perpendicular to the axis A4 of the fourth bearing 52.

The second bearing 48 and the third bearing 50 each present a bearing surface 49, 51 with the bearing surface 49 of the second bearing 48 spaced from and facing the bearing surface 51 of the third bearing 50 for receiving one of the cables 18, 20 therebetween, e.g., the first cable 18 as shown in FIGS. 1 and 2. The first bearing 46 presents a bearing surface 47 and the bearing surfaces 49, 51 of the second bearing 48 and the third bearing 50 extend transverse to the bearing surface 47 of the first bearing 46. In other words, the bearing surface 47 of the first bearing 46 extends in a plane P1 intersected by the bearing surfaces 49, 51 of the second bearing 48 and the third bearing 50, and the bearing surfaces 49, 51 of the second bearing 48 and the third bearing 50 each extend in planes P2, P3, respectively, intersected by the bearing surface 47 of the first bearing 46. The bearing surfaces 49, 51 of the second bearing 48 and third bearing 50 are typically spaced from the bearing surface 47 of the first bearing 46 along the plane P1, as shown in FIG. 3, but, alternatively, can contact the bearing surface 47 of the first bearing 46 without departing from the nature of the present invention.

The fifth bearing 54 presents a bearing surface 55 spaced from and facing the bearing surface 51 of the third bearing 50 for receiving one of the cables 18, 20 therebetween, e.g., the second cable 20 as shown in FIGS. 1 and 2. The fourth bearing 52 presents a bearing surface 53 and the bearing surfaces 51, 55 of the third bearing 50 and the fifth bearing 54 extend transverse to the bearing surface 53 of the fourth bearing 52. In other words, the bearing surface 53 of the fourth bearing 52 extends in a plane P4 intersected by the bearing surfaces 51, 55 of the third bearing 50 and the fifth bearing 54, and the bearing surfaces 51 of the third bearing 50 and the fifth bearing 54 each extend in planes P3, P5, respectively, intersected by the bearing surface 53 of the fourth bearing 52. The bearing surfaces 51, 55 of the third bearing 50 and fifth bearing 54 are typically spaced from the bearing surface 53 of the fourth bearing 52 along the plane P4, as shown in FIG. 3B, but alternatively can contact the bearing surface 53 of the fourth bearing 52 without departing from the nature of the present invention.

Figure 3A:
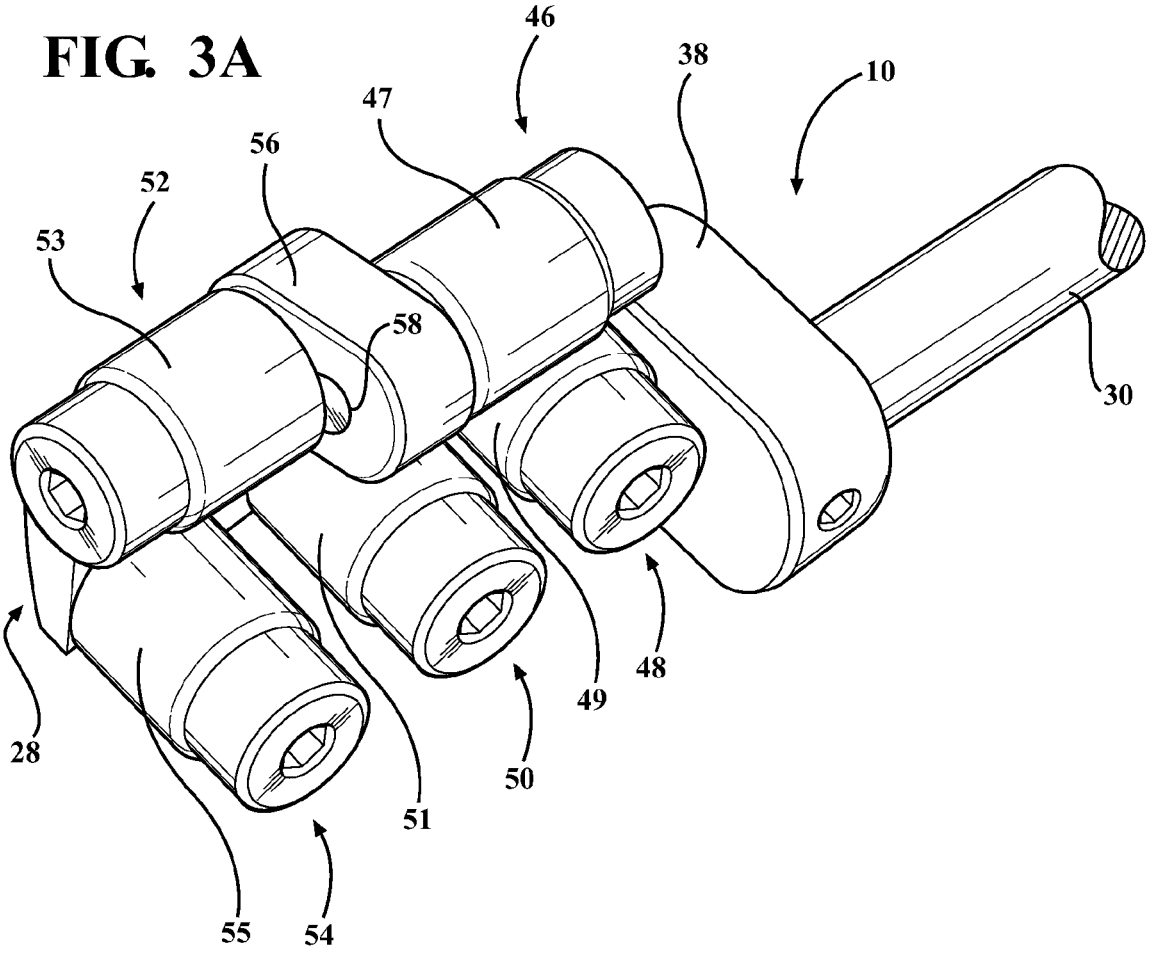
FIG. 3A is a perspective view of the first embodiment of the cable guard.
Figure 3B:
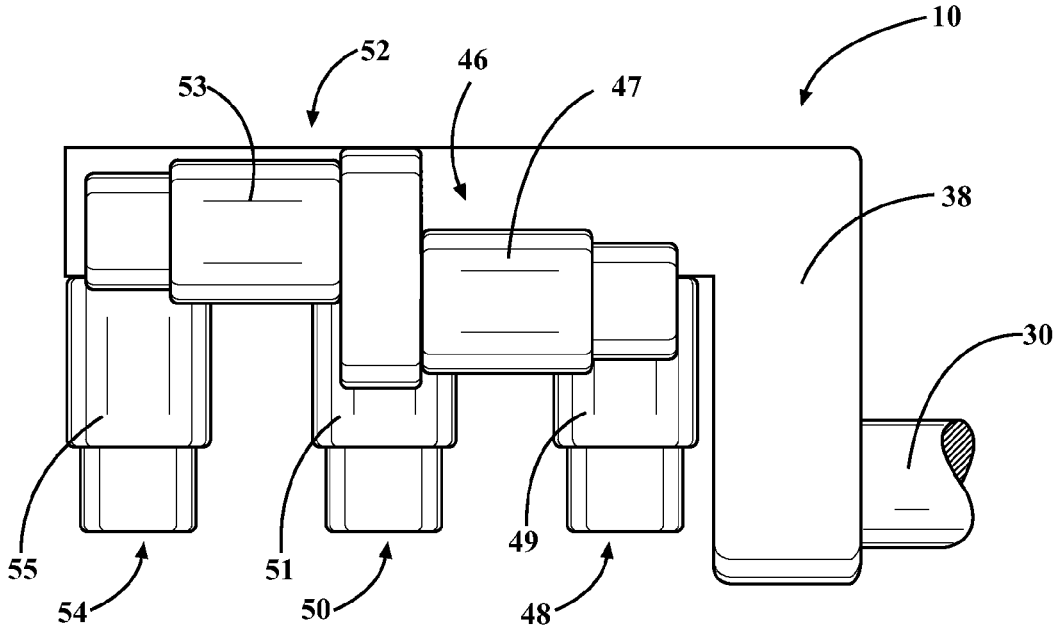
FIG. 3B is a top view of the cable guard of FIG. 3A.
Figure 5:
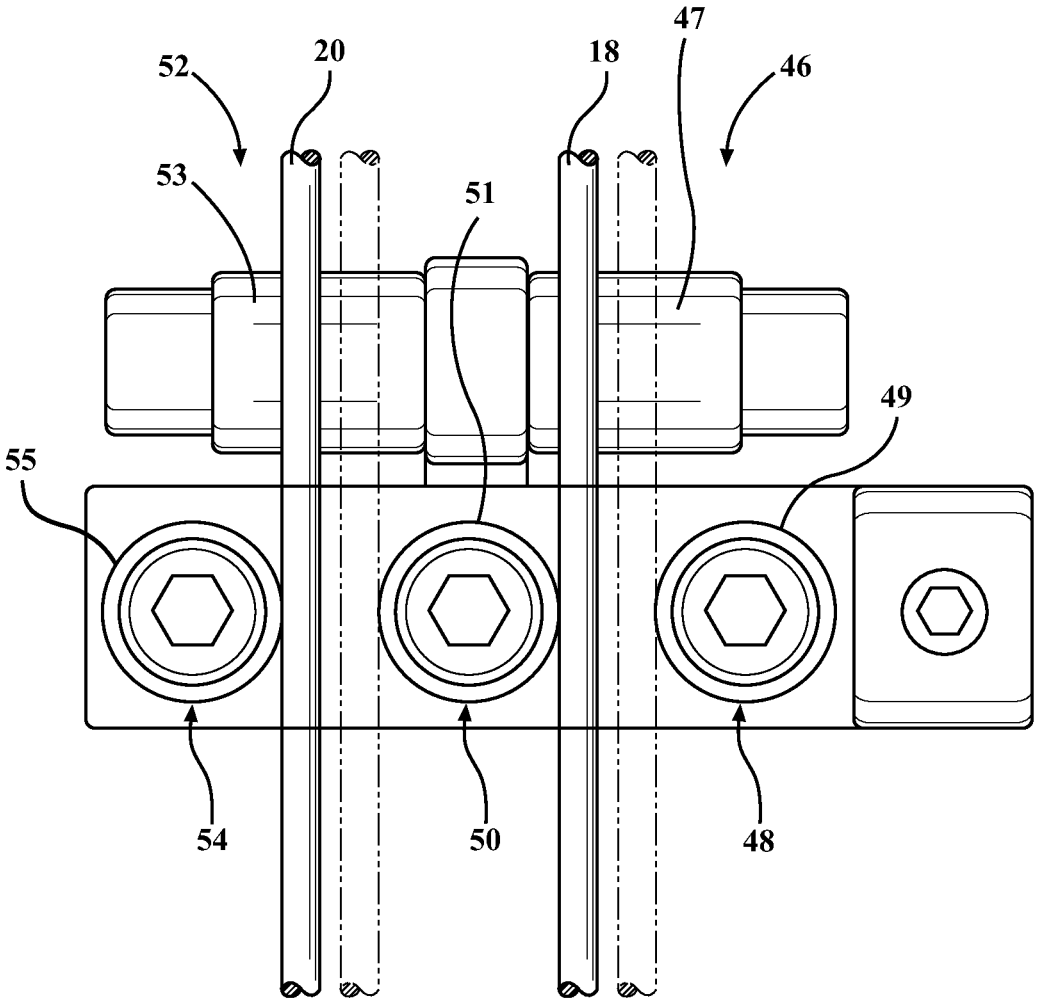
FIG. 5 is a side view of the first embodiment of the cable guard with cables of the compound bow shown in the drawn position and with the brace position in broken lines.
Figure 6:
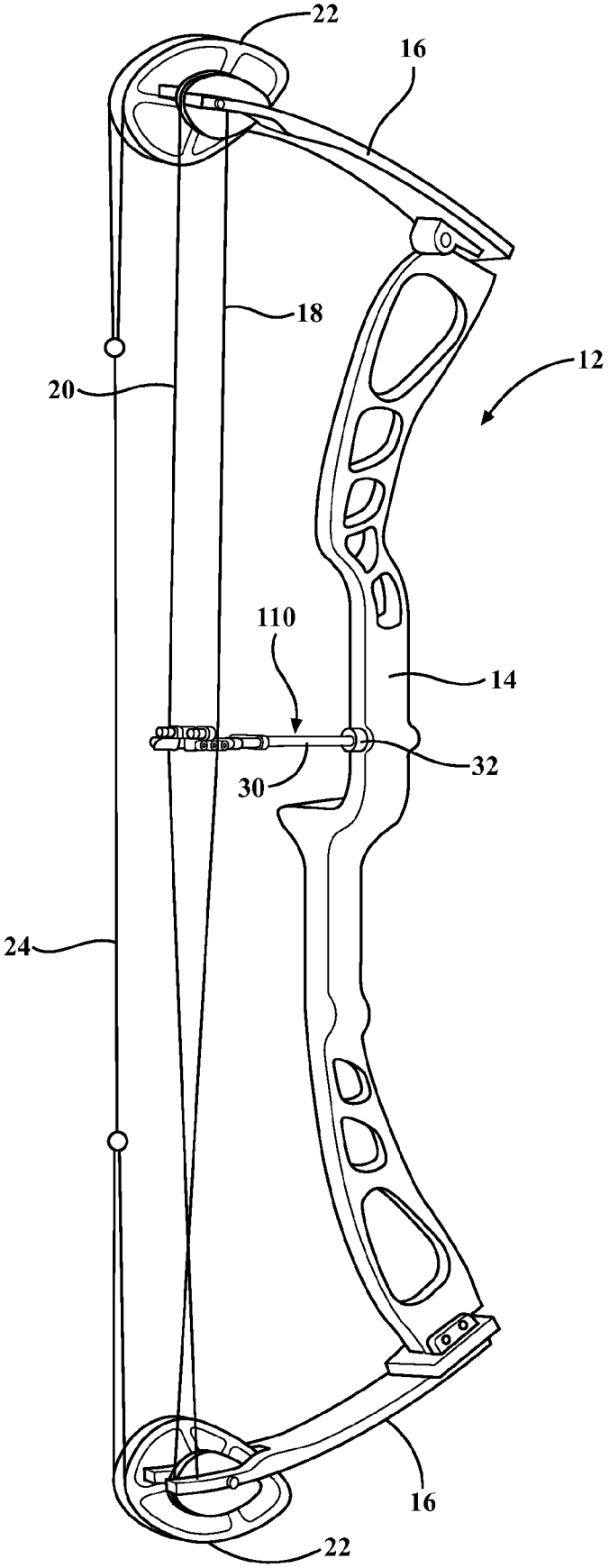
FIG. 6 is a perspective view of a compound bow in a brace position and including a second embodiment of the cable guard.

As best shown in FIGS. 3A, 3B, and 5, the first cable 18 contacts the bearing surface 47 of the first bearing 46 between the bearing surfaces 49, 51 of the second bearing 48 and the third bearing 50. The second cable 20 contacts the bearing surface 53 of the fourth bearing 52 between the bearing surfaces 51, 55 of the third bearing 50 and the fifth bearing 54. In the configuration where the bearings are rotatable, as the string 24 is moved between the brace position and the drawn position, the cables 18, 20 rotate the first bearing 46 and the second bearing 48. This rotation reduces friction and associated wear on the cables 18, 20.

When the bow 12 is in the brace position, the first cable 18 is biased toward the second bearing 48 and the second cable 20 is biased toward the third bearing 50. As the string 24 is moved to the drawn position, the geometry of the limbs 16 change to bias the first cable 18 toward the third bearing 50 and to bias the second cable 20 toward the fifth bearing 54.

With reference to FIG. 5, the bearing surfaces 49, 51 of the second bearing 48 and the third bearing 50 are typically spaced from each other a distance greater than the diameter of the first cable 18. The bearing surfaces 51, 55 of the third bearing 50 and the fifth bearing 54 are typically spaced from each other a distance greater than the diameter of the second cable 20. In such a configuration, the first cable 18 and the second cable 20 move fore and aft relative to the cable guard 10 as the string 24 is moved from the brace position to the drawn position.

Specifically, when the string 24 is in the brace position, the first cable 18 contacts the bearing surface 49 of the second bearing 48 and the second cable 20 contacts the bearing surface 51 of the third bearing 50. During movement of the string 24 from the brace position to the drawn position, the first cable 18 slides from the second bearing 48 to the third bearing 50 along the bearing surface 47 of the first bearing 46 and the second cable 20 slides from the third bearing 50 to the fifth bearing 54 along the bearing surface 53 of the fourth bearing 52. Alternatively, the bearing surfaces 49, 51 of the second bearing 48 and the third bearing 50 are spaced from each other a distance approximately equal to the diameter of the first cable 18 and the bearing surfaces 51, 55 of the third bearing 50 and the fifth bearing 54 are spaced from each other a distance approximately equal to the diameter of the second cable 20. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

Figure 4:
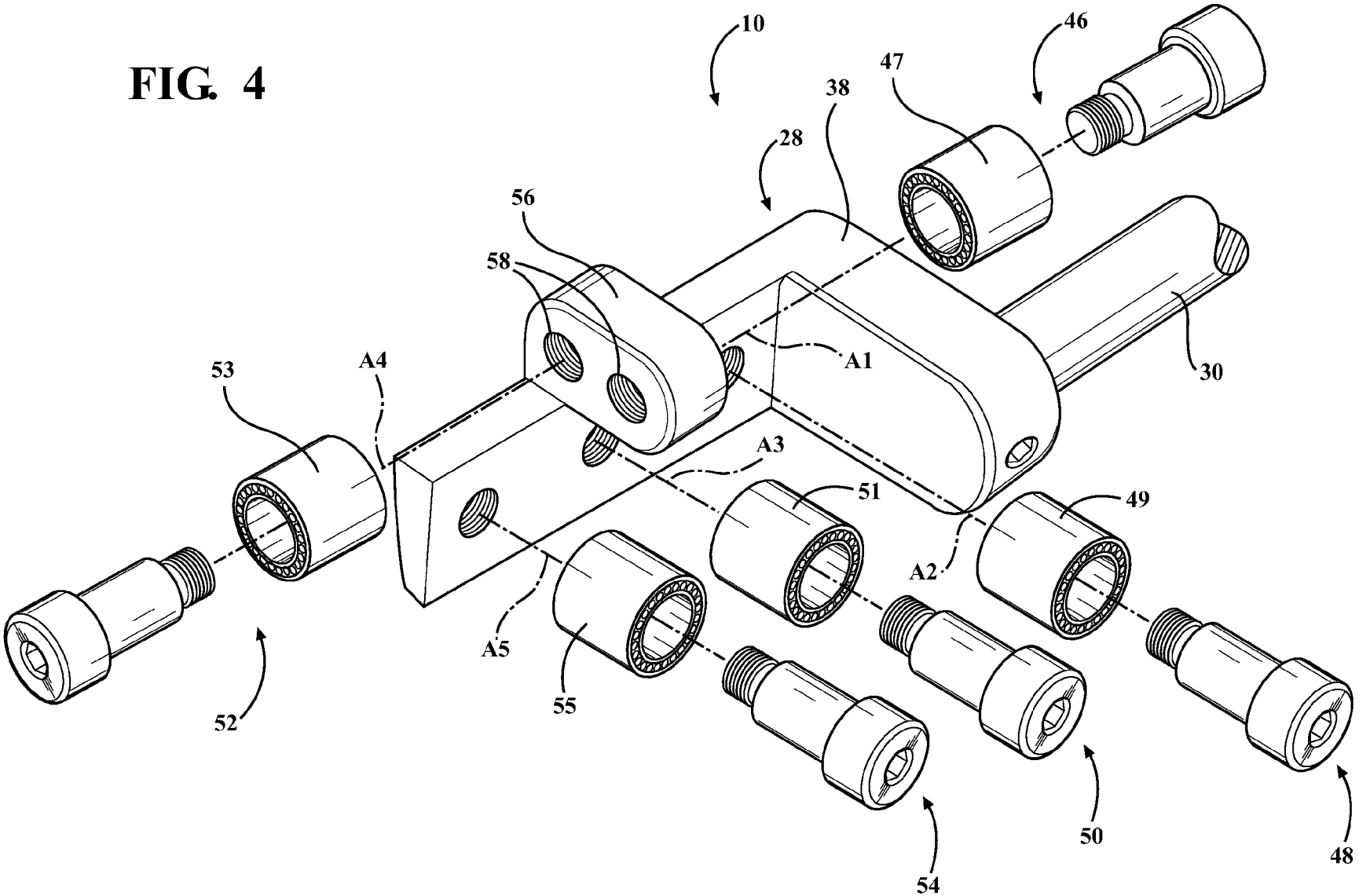
FIG. 4 is an exploded view of the first embodiment of the cable guard.

With reference to FIG. 4, the frame 28 includes an extension 56 extending from the base 38. The first bearing 46 and the fourth bearing 52 are assembled to the extension 56. Specifically, the extension 56 defines a pair of holes 58 receiving the first bearing 46 and the fourth bearing 52. The first bearing 46 and the fourth bearing 52 can be interchangeably engaged with the holes 58. In other words, the first bearing 46 can engage either hole 58 and the fourth bearing 52 can engage the other hole 58. The first bearing 46 and the fourth bearing 52 can engage the holes 58 in any suitable fashion without departing from the nature of the present invention.

As shown in FIGS. 1 and 2, the first bearing 46 and the fourth bearing 52 are typically disposed above the second bearing 48, third bearing 50, and fifth bearing 54 when the cable guide 10 is assembled to the riser 14. Alternatively, the first bearing 46 and fourth bearing 52 can be disposed below the second bearing 48, third bearing 50, and fifth bearing 54.

With reference to FIGS. 6-8, the second embodiment of the cable guard 110 includes a first bearing set 60 and a second bearing set 62. The first bearing set 60 and the second bearing set 62 are typically mirror images of each other. As shown in FIG. 6, the cable guard 110 deflects the first cable 18 to one side of the cable guard 110 and deflects the second cable 20 to the other side of the cable guard 110. The arrow 26 is loaded onto the riser 14 through a gap between the first cable 18 and the second cable 20.

Figure 7A:
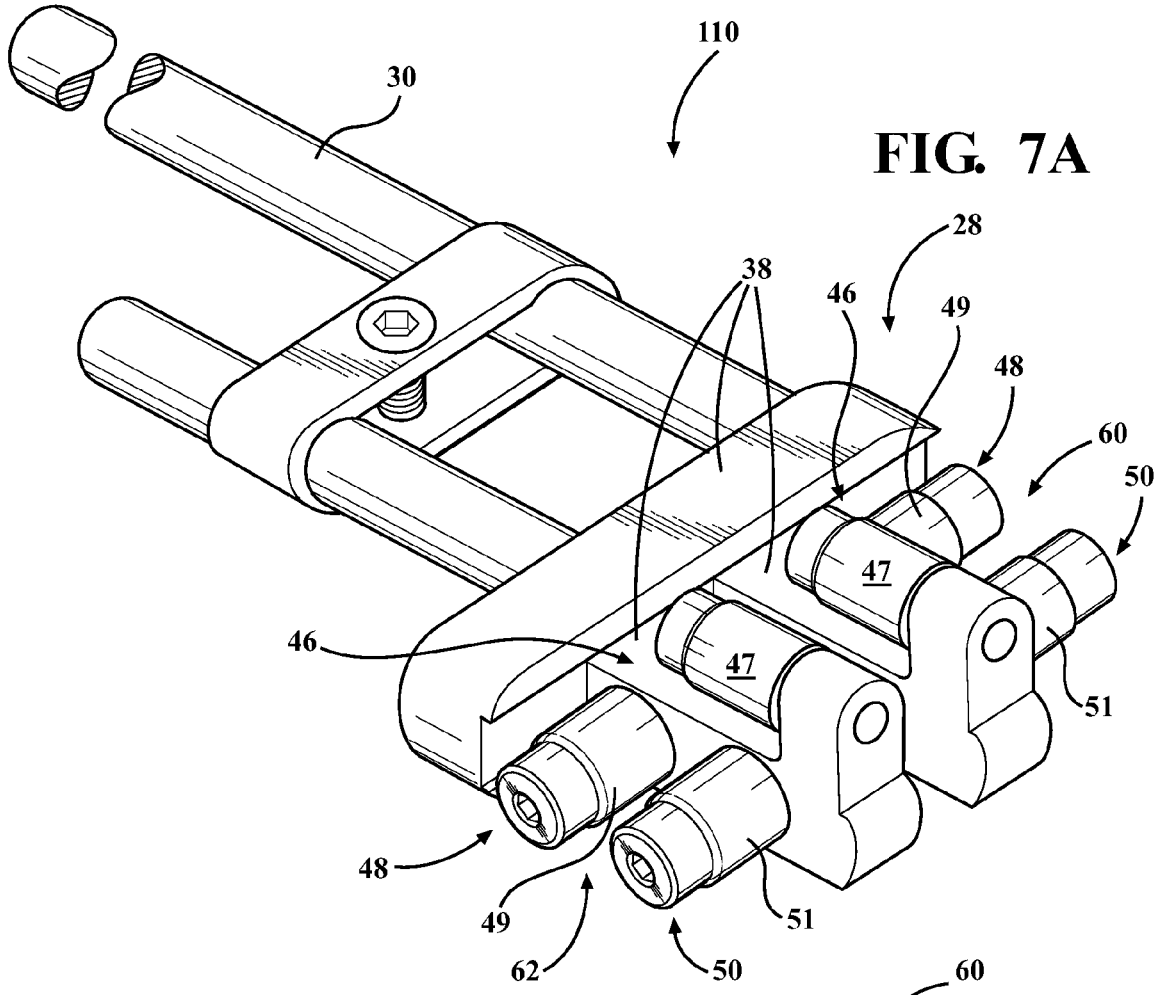
FIG. 7A is a perspective view of the cable guard of FIG. 6.
Figure 7B:
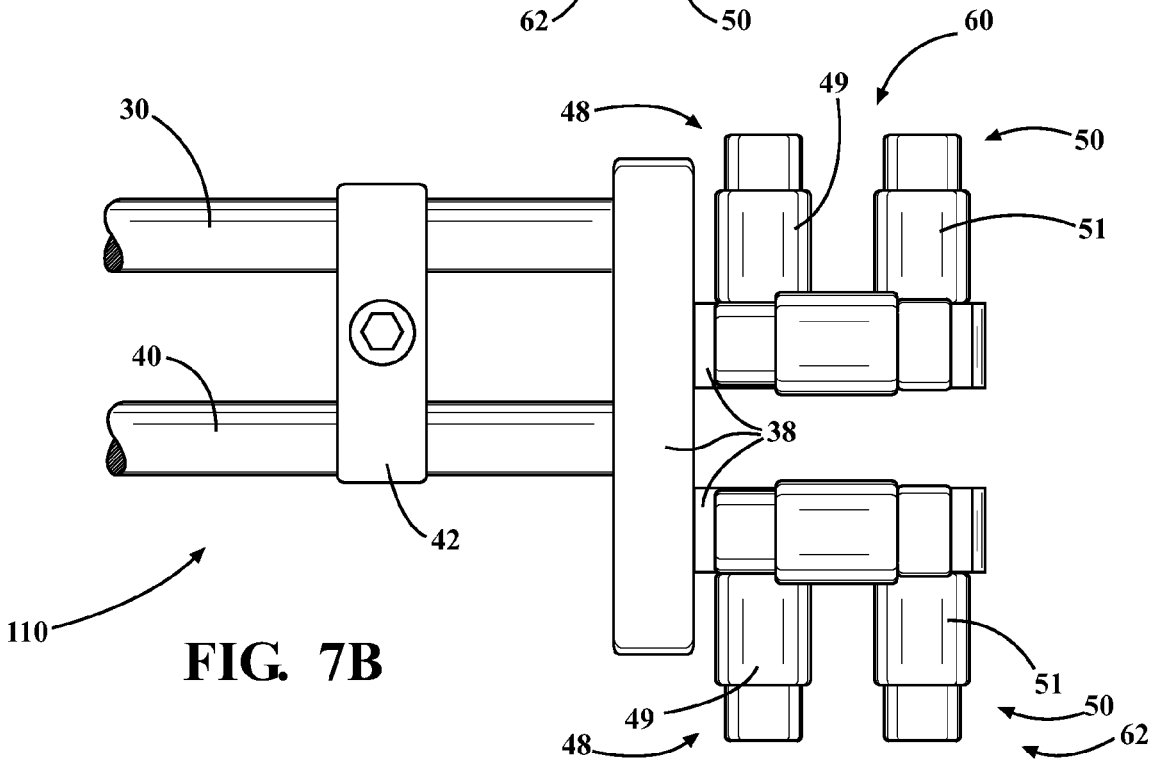
FIG. 7B is a top view of the cable guard of FIG. 7A.
Figure 8:
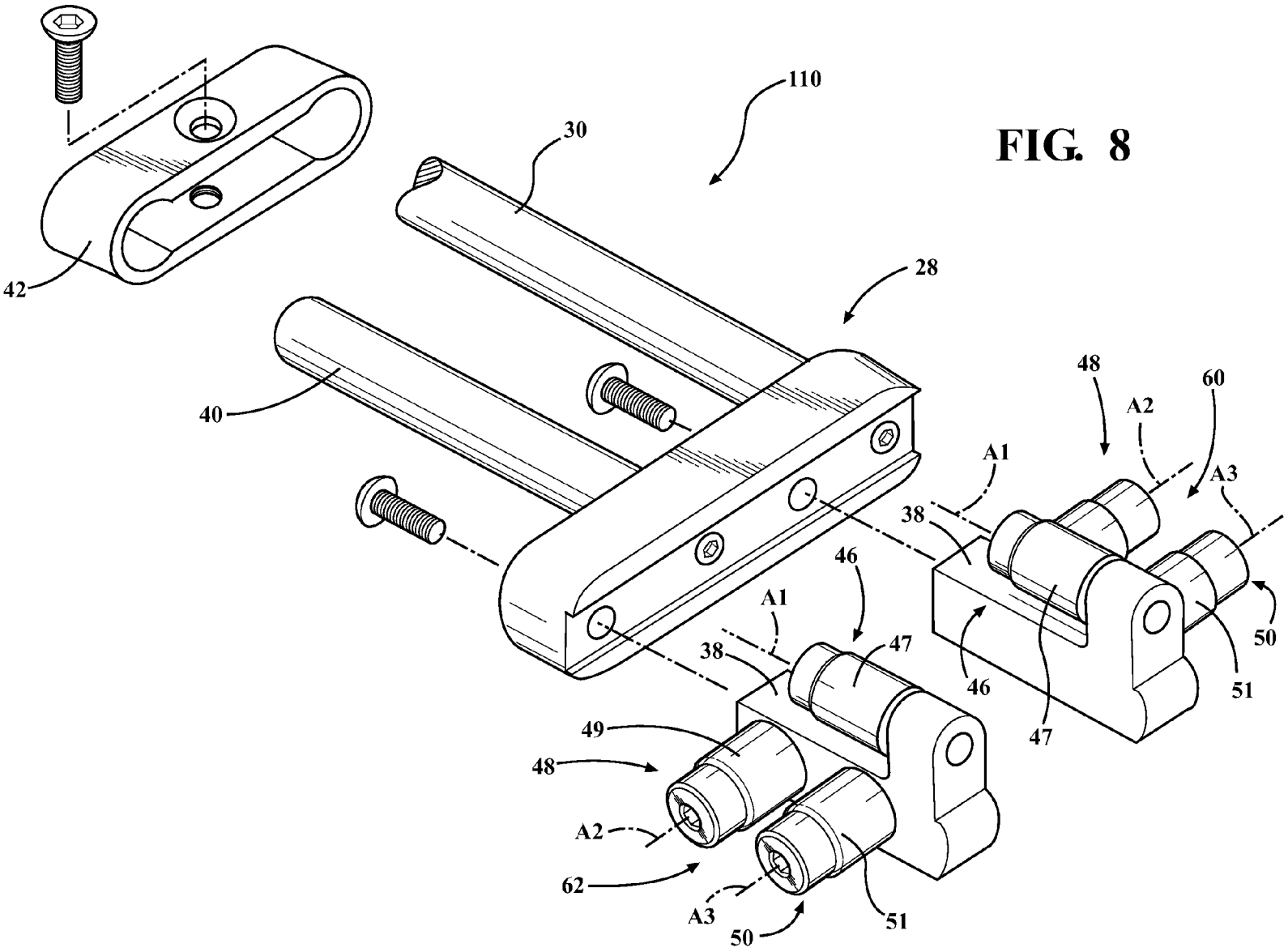
FIG. 8 is an exploded view of the second embodiment of the cable guard.

With reference to FIGS. 7A, 7B, and 8, the frame 28 includes two bases 38 spaced from each other. One base 38 supports the first bearing set 60 and the other base 38 supports a second bearing set 62. As shown in FIG. 8, for example, the bases 38 can be connected to the rest of the frame 28 through holes (not numbered) through which screws engage the bases 38. Alternatively, the bases 38 can, for example, be connected to the rest of the frame 28 through slots (not shown) that allow for adjustment of the bases 38 relative to the rest of the frame 28. The frame 28 defines two opposing shelves (not numbered) that receive the bases 38, as shown in FIG. 8.

The first bearing set 60 and the second bearing set 62 each include a first bearing 46, a second bearing 48, and a third bearing 50. The description of the first bearing 46, second bearing 48, and third bearing 50 above for the first embodiment, including relative positioning, is also applicable to the first bearing 46, second bearing 48, and third bearing 50 of both the first bearing set 60 and second bearing set 62 of the second embodiment.

The first cable 18 contacts the bearing surface 47 of the first bearing 46 of the first bearing set 60 and the second cable 20 contacts the bearing surface 47 of the first bearing 46 of the second bearing set 62. In the configuration where the bearings are rotatable, as the string 24 is moved between the brace position and the drawn position, the cables 18, 20 rotate the first bearing 46 of the first bearing set 60 and the second bearing set 62. This rotation reduces friction and associated wear on the cables 18, 20.

When the string 24 is in the brace position, the first cable 18 is biased toward the second bearing 48 of the first bearing set 60 and the second cable 20 is biased toward the second bearing 48 of the second bearing set 62. As the string 24 is moved to the drawn position, the geometry of the limbs 16 change to bias the first cable 18 toward the third bearing 50 and to bias the second cable 20 toward the fifth bearing 54.

With reference to FIGS. 7A and 7B, the bearing surfaces 49, 51 of the second bearing 48 and the third bearing 50 of the first bearing set 60 and the second bearing set 62, respectively, are typically spaced from each other a distance greater than the diameters of the first cable 18 and second cable 20 (not shown in FIGS. 7A and 7B), respectively. In such a configuration, the first cable 18 and the second cable 20 move fore and aft relative to the cable guard 110 as the string 24 is moved between the brace position and the drawn position.

Specifically, when the string 24 is in the brace position, the first cable 18 and the second cable 20 contact the bearing surface 47 of the first bearing 46 of the first bearing set 60 and the second bearing set 62, respectively. During movement of the string 24 from the brace position to the drawn position, the first cable 18 and the second cable 20 slide from the respective second bearing 48 to the third bearing 50 along the bearing surface 47 of the first bearing 46. Alternatively, the bearing surfaces 49, 51 of the second bearing 48 and the third bearing 50 of the first bearing set 60 and the second bearing set 62 are spaced from each other a distance approximately equal to the diameter of the first cable 18 and the second cable 20, respectively. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

The second embodiment of the cable guard 110 is assembled to the riser 14 by inserting the cable guard 110 between the first cable 18 and the second cable 20. The rod 30 is coupled to the riser 14, e.g., the rod 30 is inserted into the riser 14, and the first bearing set 60 and second bearing set 62 are inserted between the first cable 18 and the second cable 20. The frame 28 is initially positioned relative to the riser 14 in a position rotated relative to the final position shown in FIG. 6 to aid in the ease of insertion of the first bearing set 60 and the second bearing set 62 between the first cable 18 and the second cable 20. The first cable 18 is inserted between the second bearing 48 and the third bearing 50 of the first bearing set 60 and the second cable 20 is inserted between the second bearing 48 and the third bearing 50 of the second bearing set 62. The frame 28 is then rotated relative to the riser 14 to the position shown in FIG. 6 such that the first bearing 46 of the first bearing set 60 and the first bearing 46 of the second bearing set 62 force the first cable 18 and the second cable 20 in opposite directions.

Figure 9:
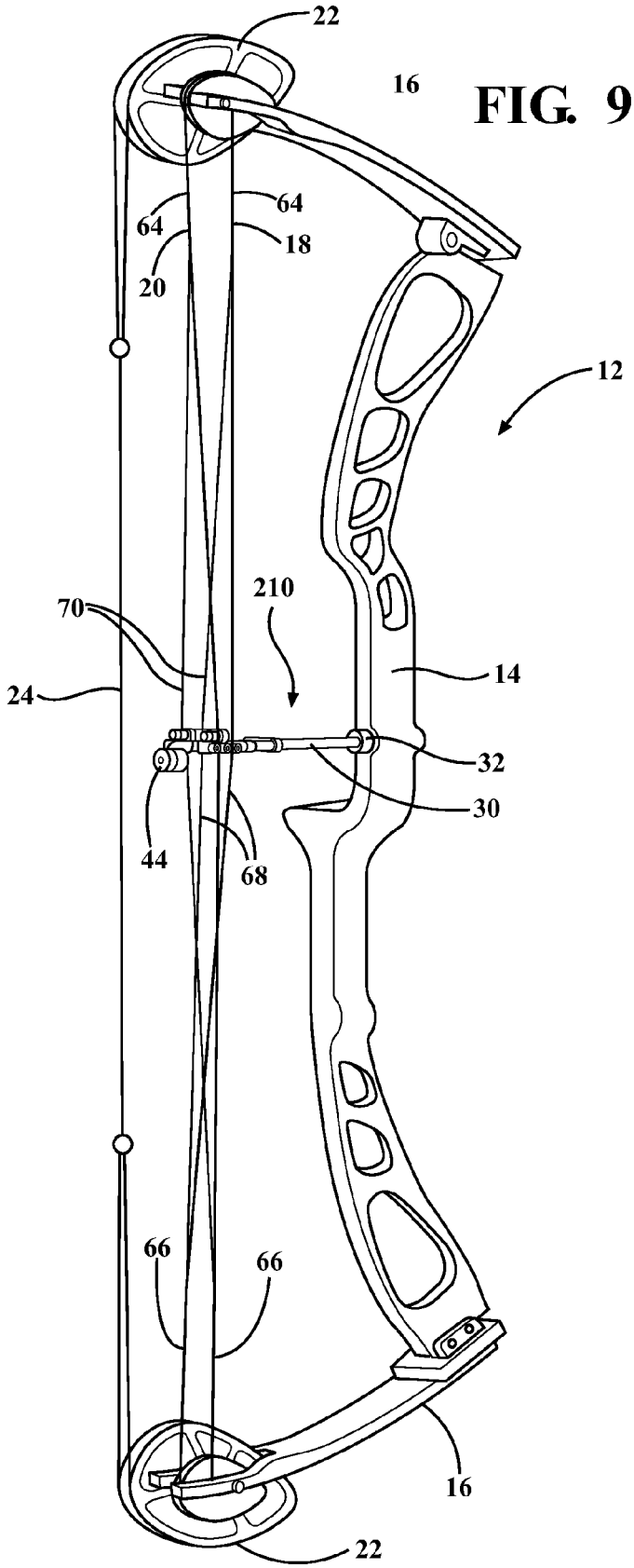
FIG. 9 is a perspective view of a compound bow in a brace position and including a third embodiment of the cable guard.
Figure 10:
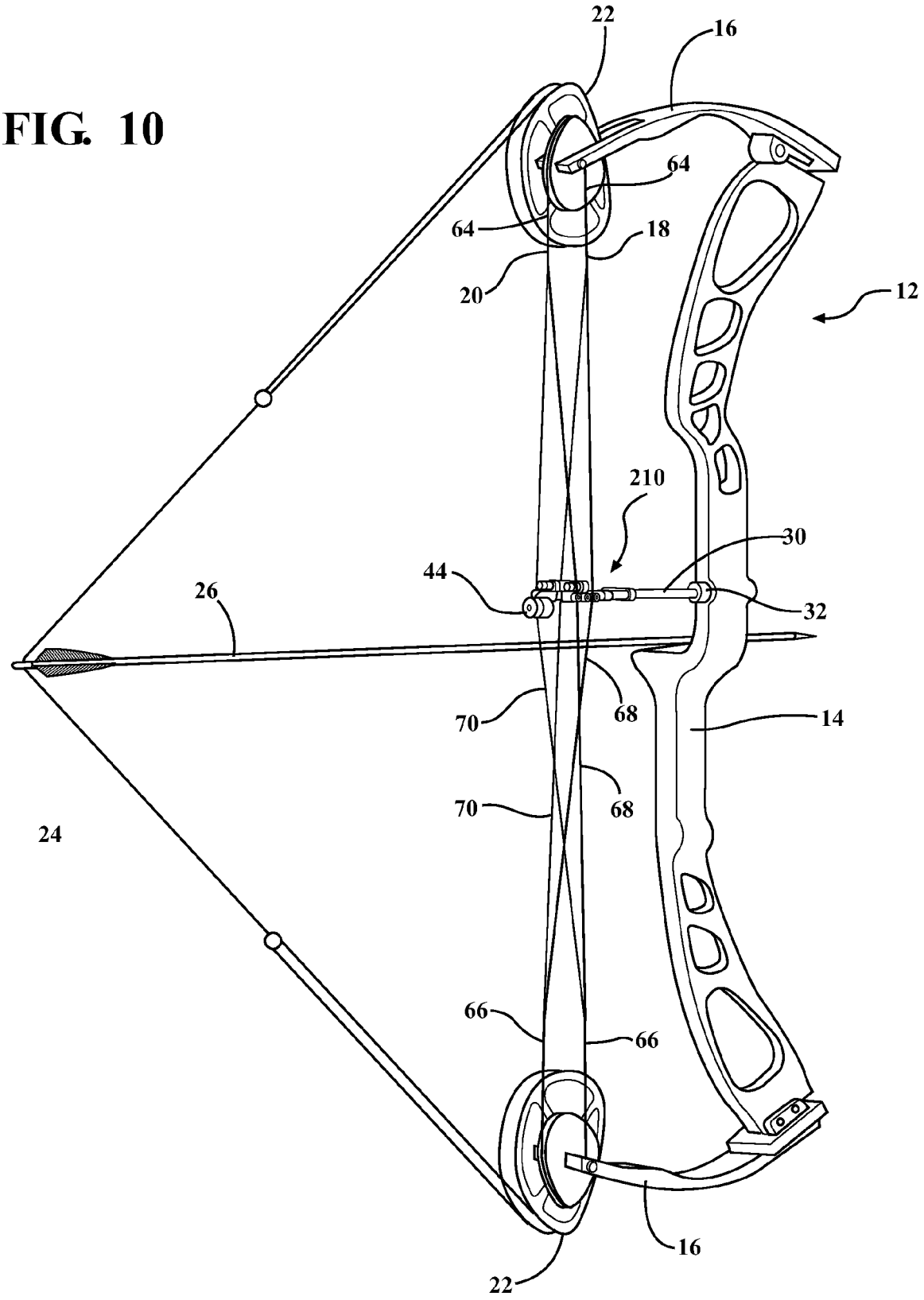
FIG. 10 is a perspective view of the compound bow of FIG. 9 in the drawn position.

With reference to FIGS. 9-12, the third embodiment of the cable guard 210 includes a first bearing set 260 and a second bearing set 262. The first bearing set 260 and the second bearing set 262 are typically mirror images of each other. As shown in FIGS. 9 and 10, the cable guard 210 deflects split portions of the first cable 18 to opposite sides of the cable guard 210 and deflects split portions of the second cable 20 to opposite sides of the cable guard 210. The arrow 26 is loaded onto the riser 14 between the split portions of the first cable 18 and between the split portions of the second cable 20.

Specifically, as shown in FIGS. 9 and 10, the first cable 18 and the second cable 20 each include an upper unsplit portion 64 for attachment to the limb 16 or pulley 22 and a lower unsplit portion 66 for attachment to the limb 16 or pulley 22. The first cable 18 and the second cable 20 each include a first split portion 68 and a second split portion 70 extending between the upper unsplit portion 64 and the lower unsplit portion 66.

Figure 13:
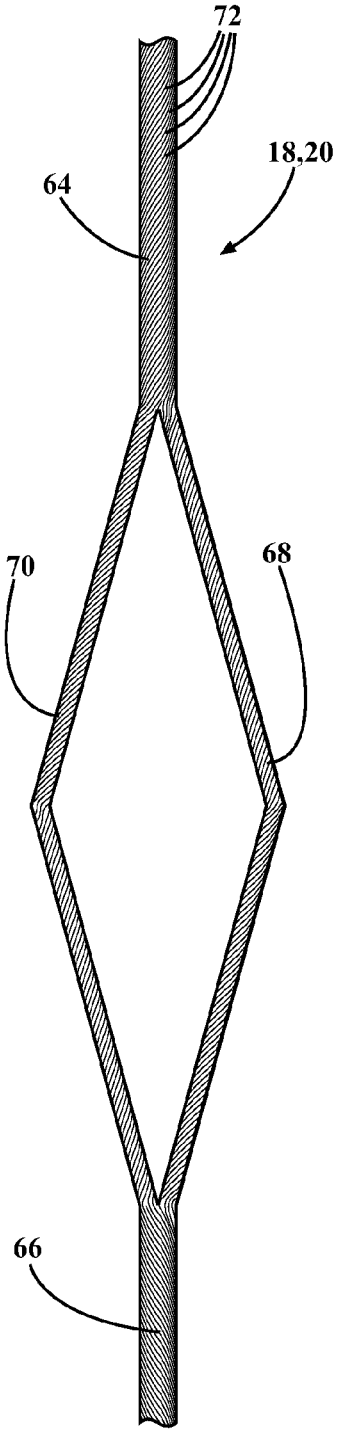
FIG. 13 is a perspective view of a cable of the compound bow of FIG. 9.

With reference to FIG. 13, for example, the first cable 18 and the second cable 20 are each formed of a plurality of strands 72 twisted together. For example, the first cable 18 and second cable 20 can each include 24 strands 72, as shown in FIG. 13, or alternatively could include any suitable number of strands 72. Regardless of the number of strands 72, all strands 72 are twisted together at the upper unsplit portion 64 and the lower unsplit portion 66. The strands 72 are divided between the first split portion 68 and the second split portion 70 between the upper unsplit portion 64 and the lower unsplit portion 66.

Figure 11B:
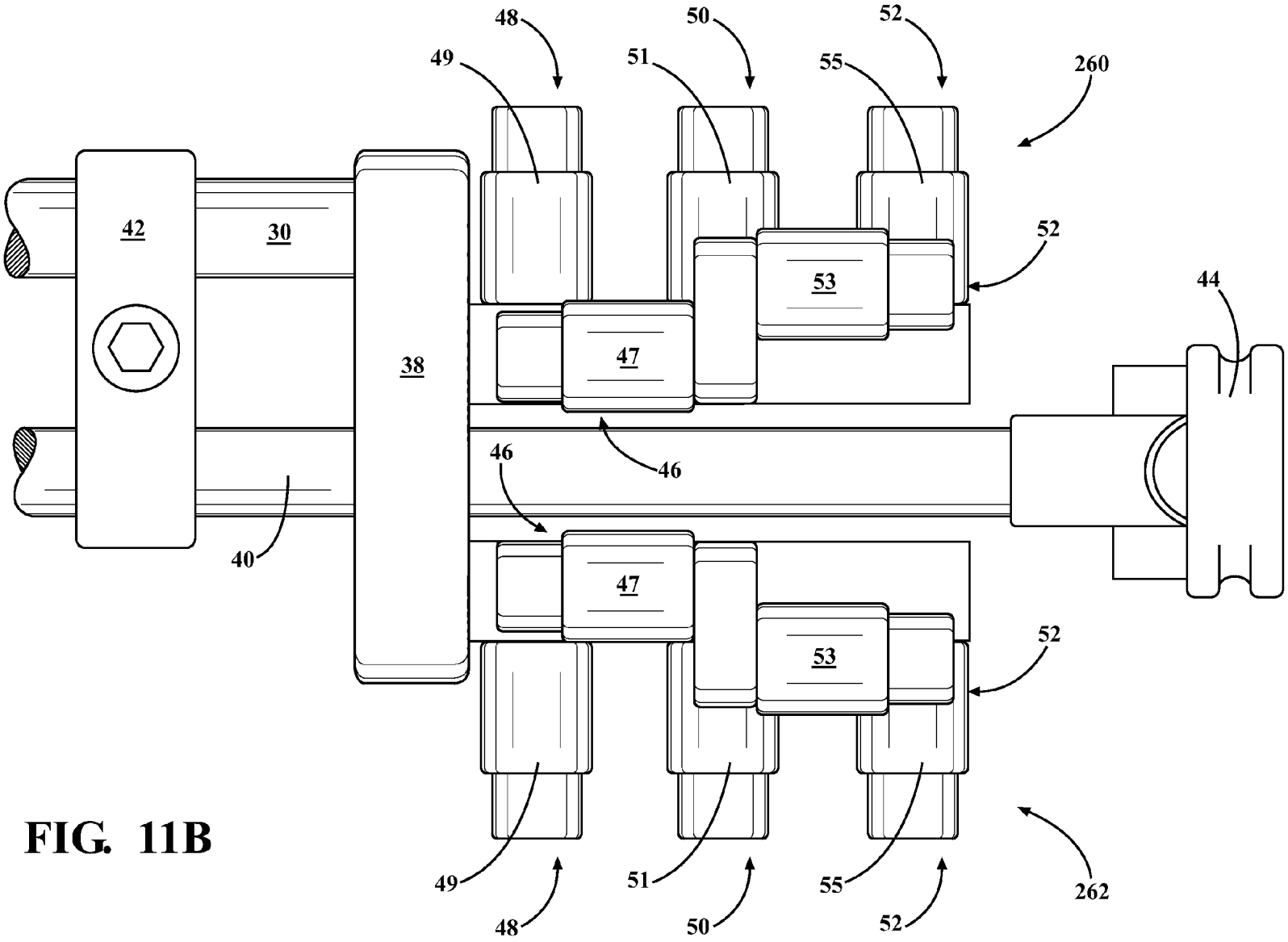
FIG. 11B is a top view of the third embodiment of the cable guard.
Figure 12:
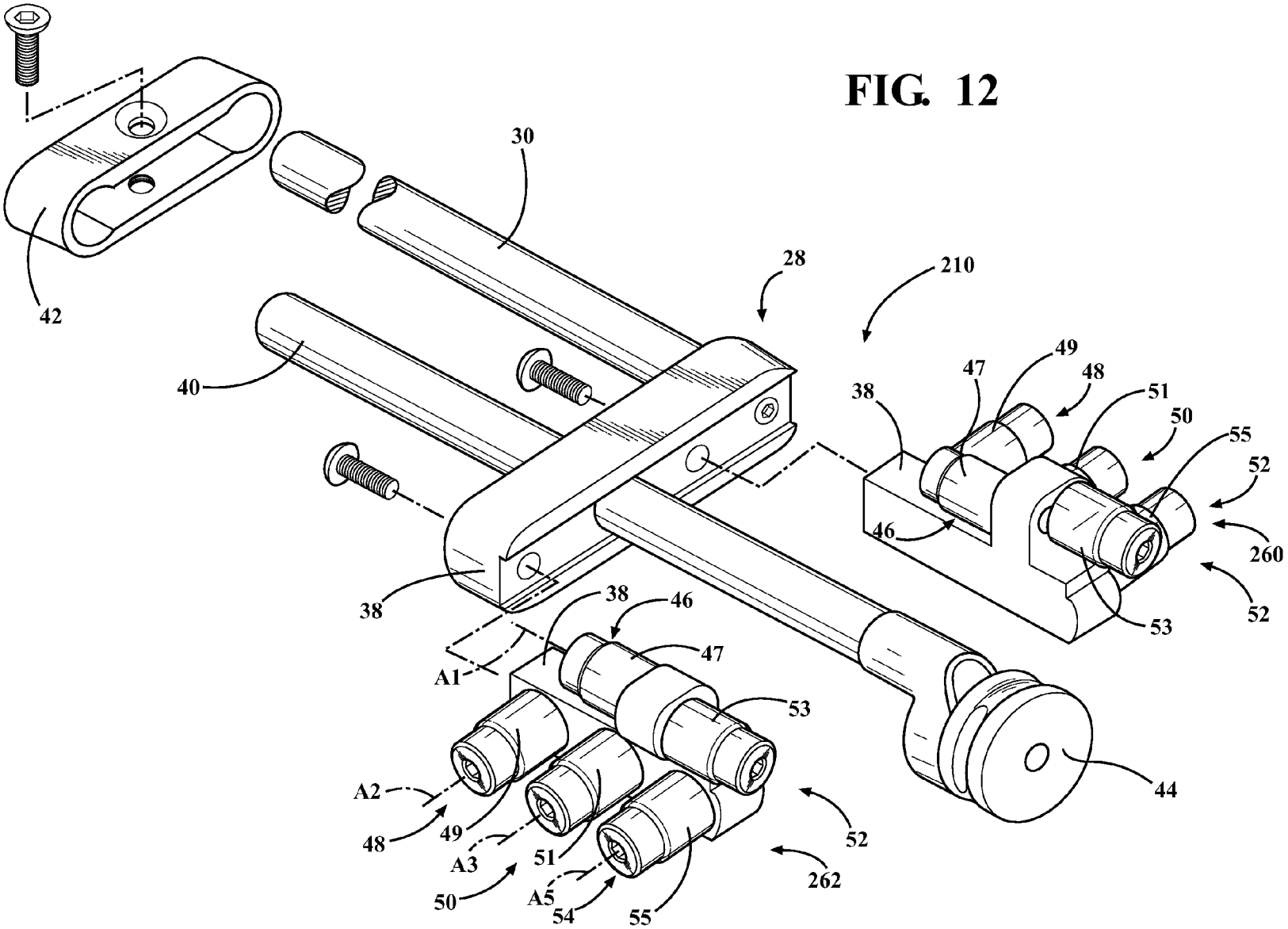
FIG. 12 is an exploded view of the third embodiment of the cable guide.

With reference to FIGS. 11A, 11B, and 12, the frame 28 includes two bases 38 spaced from each other. One base 38 supports the first bearing set 260 and the other base 38 supports a second bearing set 262. Similar to the second embodiment, for example, the bases 38 can be connected to the rest of the frame 28 through holes (not shown) through which screws (not shown) engage the bases 38. Alternatively, the bases 38 can, for example, be connected to the rest of the frame 28 through slots (not shown) that allow for adjustment of the bases 38 relative to the rest of the frame 28. The frame 28 defines two opposing shelves (not numbered) that receive the bases 38, as shown in FIG. 11A. The string suppressor 44 extends between the first bearing set 260 and the second bearing set 262.

The first bearing set 260 and the second bearing set 262 each include a first bearing 46, a second bearing 48, a third bearing 50, a fourth bearing 52, and a fifth bearing 54. The description of the first bearing 46, second bearing 48, third bearing 50, fourth bearing 52, and fifth bearing 54 above for the first embodiment, including relative positioning, is also applicable to the first bearing 46, second bearing 48, third bearing 50, fourth bearing 52, and fifth bearing 54 of both the first bearing set 260 and second bearing set 262 of the third embodiment.

The first split portion 68 of the first cable 18 contacts the bearing surface 47 of the first bearing 46 of the first bearing set 260 and the second split portion 70 of the first cable 18 contacts the bearing surface 47 of the first bearing 46 of the second bearing set 262. Similarly, the first split portion 68 of the second cable 20 contacts the bearing surface 53 of the fourth bearing 52 of the first bearing set 260 and the second split portion 70 of the second cable 20 contacts the bearing surface 53 of the fourth bearing 52 of the second bearing set 262. In the configuration where the bearings rotate, as the string 24 is moved between the brace position and the drawn position, the cables 18, 20 rotate the first bearing 46 and the fourth bearing 52 of the first bearing set 260 and the second bearing set 262. This rotation reduces friction and associated wear on the cables 18, 20.

When the string 24 is in the brace position, the first split portion 68 of the first cable 18 is biased toward the second bearing 48 of the first bearing set 260 and the second split portion 70 of the first cable 18 is biased toward the second bearing 48 of the second bearing set 262. Similarly, when the string 24 is in the brace position, the first split portion 68 of the second cable 20 is biased toward the third bearing 50 of the first bearing set 260 and the second split portion 70 of the first cable 18 is biased toward the second bearing 48 of the second bearing set 262. As the string 24 is moved to the drawn position, the geometry of the limbs 16 change to bias the first split portion 68 of the first cable 18 toward the third bearing 50 of the first bearing set 260 and to bias the second split portion 70 of the first cable 18 toward the third bearing 50 of the second bearing set 262. Likewise, as the string 24 is moved to the drawn position, the first split portion 68 of the second cable 20 is biased toward the fifth bearing 54 of the first bearing set 260 and the second split portion 70 of the second cable 20 is biased toward the fifth bearing 54 of the second bearing set 262.

Similar to FIG. 5 discussed above, the bearing surfaces 49, 51 of the second bearing 48 and the third bearing 50 of the first bearing set 260 and the second bearing set 262 are typically spaced from each other a distance greater than the diameter of the first split portion 68 and the second split portion 70, respectively, of the first cable 18. The bearing surfaces 51, 55 of the third bearing 50 and the fifth bearing 54 of the first bearing set 260 and the second bearing set 262 are typically spaced from each other a distance greater than the diameter of the first split portion 68 and the second split portion 70, respectively, of the second cable 20. In such a configuration, the first split portions 68 and the second split portions 70 can move fore and aft relative to the cable guard 210 as the string 24 is moved from the brace position to the drawn position.

Specifically, when the string 24 is in the brace position, the first split portion 68 of the first cable 18 contacts the bearing surface 49 of the second bearing 48 of the first bearing set 260 and the second split portion 70 of the first cable 18 contacts the bearing surface 49 of the second bearing 48 of the second bearing set 262. During movement of the string 24 from the brace position to the drawn position, the first split portion 68 and the second split portion 70 slide from the respective second bearing 48 to the third bearing 50 along the bearing surface 47 of the first bearing 46. Likewise, when the string 24 is in the brace position, the first split portion 68 of the second cable 20 contacts the bearing surface 51 of the third bearing 50 of the first bearing set 260 and the second split portion 70 of the second cable 20 contacts the bearing surface 51 of the third bearing 50 of the second bearing set 262. During movement of the string 24 from the brace position to the drawn position, the first split portion 68 and the second split portion 70 slide from the respective third bearing 50 to the fifth bearing 54 along the bearing surface 53 of the fourth bearing 52. Alternatively, the bearing surfaces 49, 51 of the second bearing 48 and the third bearing 50 are spaced from each other a distance approximately equal to the diameter of the first split portions 68 and the bearing surfaces 51, 55 of the third bearing 50 and the fifth bearing 54 are spaced from each other a distance approximately equal to the diameter of the second split portions 70. In any event, in the configuration where the bearings are rotatable, the cables 18, 20 rotate any of the bearings that the cables 18, 20 contact during movement between the brace position and the drawn position and this rotation reduces friction and associated wear on the cables 18, 20.

The third embodiment of the cable guard 210 is assembled to the riser 14 by inserting the cable guard 210 between the first split portion 68 and the second split portion 70 of the first cable 18 and between the first split portion 68 and the second split portion 70 of the second cable 20. The frame 28 is coupled to the riser 14 and the first bearing set 260 and second bearing set 262 are inserted between the first split portion 68 and second split portion 70 of the first cable 18 and between the first split portion 68 and second split portion 70 of the second cable 20. The frame 28 is initially inserted into the riser 14 in a position rotated relative to the final position shown in FIG. 9 to aid in the ease of insertion of the first bearing set 260 and the second bearing set 262 between the split portions 68, 70. When the split portions 68, 70 are placed between the appropriate bearings, the frame 28 is rotated relative to the riser 14 to the position shown in FIG. 9 such that the first bearing 46 of the first bearing set 260 and the first bearing 46 of the second bearing set 262 force the first split portion 68 and the second split portion 70 in opposite directions.

The invention has been described in an illustrative manner, and it is to be understood that the terminology which has been used is intended to be in the nature of words of description rather than of limitation. Many modifications and variations of the present invention are possible in light of the above teachings, and the invention may be practiced otherwise than as specifically described.

What is claimed is:

1. A cable guard for a compound bow, the compound bow including spaced apart limbs and a cable extending between the limbs, said cable guard comprising:

a frame for attachment to the compound bow;

a first bearing supported by said frame and extending along an axis for contacting the cable; and a second bearing and a third bearing each extending along a respective axis transverse to said axis of said first bearing, said second bearing and said third bearing each presenting a bearing surface with the bearing surface of the second bearing spaced from and facing the bearing surface of the third bearing for receiving the cable therebetween;

wherein said first bearing is rotatable about said axis of said first bearing, said second bearing is rotatable about said axis of said second bearing, and said third bearing is rotatable about said axis of said third bearing.

2. The cable guard as set forth in claim 1 wherein said first bearing presents a bearing surface and wherein said bearing surfaces of said second bearing and said third bearing extend transverse to the bearing surface of the first bearing.

3. The cable guard as set forth in claim 1 wherein said axis of said second bearing is parallel to said axis of said third bearing.

4. The cable guard as set forth in claim 3 wherein said axis of said second bearing and said axis of said third bearing are perpendicular to said axis of said first bearing.

5. The cable guard as set forth in claim 1 further comprising a string suppressor extending from said frame parallel to said axis of said first bearing for contacting a string of the compound bow.

6. The cable guard as set forth in claim 1 wherein at least one of said first bearing, said second bearing, and said third bearing is a needle bearing.

7. The cable guard as set forth in claim 1 further comprising a fourth bearing extending along an axis in parallel with said axis of said first bearing and a fifth bearing extending along an axis transverse to said axis of said first bearing adjacent said third bearing.

8. The cable guard as set forth in claim 7 wherein said first, second, third, fourth, and fifth bearing form a first bearing set and further comprising a second bearing set spaced from said first bearing set, said first bearing set and said second bearing set being configured to receive the cable and another cable.

9. The cable guard as set forth in claim 1 wherein said first bearing, said second bearing, and said third bearing form a first bearing set for receiving the cable and further comprising a second bearing set spaced from said first bearing set for receiving another cable.

10. A compound bow comprising:

a riser;

a pair of limbs extending from opposing ends of said riser;

a cable extending between said limbs;

a cable guard including a frame extending from said riser;

a first bearing supported by said frame and extending along an axis, said cable contacting said first bearing; and a second bearing and a third bearing each extending along a respective axis transverse to said axis of said first bearing, said second bearing and said third bearing each presenting a bearing surface with the bearing surface of the second bearing spaced from and facing the bearing surface of the third bearing and receiving said cable therebetween;

wherein said first bearing is rotatable about said axis of said first bearing, said second bearing is rotatable about said axis of said second bearing, and said third bearing is rotatable about said axis of said third bearing.

11. The compound bow as set forth in claim 10 wherein said frame of said cable guard is stationary relative to said riser.

12. The compound bow as set forth in claim 10 wherein said first bearing presents a bearing surface in contact with said cable and wherein said bearing surfaces of said second bearing and said third bearing extend transverse to the bearing surface of the first bearing.

13. The compound bow as set forth in claim 10 wherein said axis of said second bearing is parallel to said axis of said third bearing.

14. The compound bow as set forth in claim 13 wherein said axis of said second bearing and said axis of said third bearing are perpendicular to said axis of said first bearing.

15. The compound bow as set forth in claim 10 further comprising a string extending between said limbs and wherein said cable guard includes a string suppressor extending from said frame toward said string.

16. The compound bow as set forth in claim 10 wherein at least one of said first bearing, said second bearing, and said third bearing is a needle bearing.

17. The compound bow as set forth in claim 10 further comprising a fourth bearing extending along an axis in parallel with said axis of said first bearing and a fifth bearing extending along an axis transverse to said axis of said first bearing adjacent said third bearing.

18. The compound bow as set forth in claim 17 wherein said first, second, third, fourth, and fifth bearing form a first bearing set and further comprising a second bearing set spaced from said first bearing set, said first bearing set and said second bearing set receiving said cable and another cable.

19. The compound bow as set forth in claim 10 wherein said first bearing, said second bearing, and said third bearing form a first bearing set for receiving said cable and further comprising a second bearing set spaced from said first bearing set for receiving another cable.

20. A cable guard for a compound bow, the compound bow including spaced apart limbs and a cable extending between the limbs, said cable guard comprising:

a frame for attachment to the compound bow;

a first bearing supported by said frame and extending along an axis for contacting the cable; and a second bearing and a third bearing each extending along a respective axis transverse to said axis of said first bearing, said second bearing and said third bearing each presenting a bearing surface with the bearing surface of the second bearing spaced from and facing the bearing surface of the third bearing for receiving the cable therebetween;

wherein at least one of said first bearing, said second bearing, and said third bearing is a needle bearing.

21. A cable guard for a compound bow, the compound bow including spaced apart limbs and a cable extending between the limbs, said cable guard comprising:

a frame for attachment to the compound bow;

a first bearing supported by said frame and extending along an axis for contacting the cable;

a second bearing and a third bearing each extending along a respective axis transverse to said axis of said first bearing, said second bearing and said third bearing each presenting a bearing surface with the bearing surface of the second bearing spaced from and facing the bearing surface of the third bearing for receiving the cable therebetween;

a fourth bearing extending along an axis in parallel with said axis of said first bearing;

a fifth bearing extending along an axis transverse to said axis of said first bearing adjacent said third bearing, wherein said first, second, third, fourth, and fifth bearing form a first bearing set; and a second bearing set spaced from said first bearing set, said first bearing set and said second bearing set being configured to receive the cable and another cable.

22. A compound bow comprising:

a riser;

a pair of limbs extending from opposing ends of said riser;

a cable extending between said limbs;

a cable guard including a frame extending from said riser;

a first bearing supported by said frame and extending along an axis, said cable contacting said first bearing; and a second bearing and a third bearing each extending along a respective axis transverse to said axis of said first bearing, said second bearing and said third bearing each presenting a bearing surface with the bearing surface of the second bearing spaced from and facing the bearing surface of the third bearing and receiving said cable therebetween;

wherein at least one of said first bearing, said second bearing, and said third bearing is a needle bearing.

23. A compound bow comprising:

a riser;

a pair of limbs extending from opposing ends of said riser;

a cable extending between said limbs;

a cable guard including a frame extending from said riser;

a first bearing supported by said frame and extending along an axis, said cable contacting said first bearing; and a second bearing and a third bearing each extending along a respective axis transverse to said axis of said first bearing, said second bearing and said third bearing each presenting a bearing surface with the bearing surface of the second bearing spaced from and facing the bearing surface of the third bearing and receiving said cable therebetween;

a fourth bearing extending along an axis in parallel with said axis of said first bearing;

a fifth bearing extending along an axis transverse to said axis of said first bearing adjacent said third bearing, wherein said first, second, third, fourth, and fifth bearing form a first bearing set; and a second bearing set spaced from said first bearing set, said first bearing set and said second bearing set being configured to receive said cable and another cable.

* * * * *